US008141511B1

(12) United States Patent
Dunn

(10) Patent No.: US 8,141,511 B1
(45) **Date of Patent: *Mar. 27, 2012**

(54) STABLE MARITIME VEHICLE PLATFORM

(75) Inventor: Michael J. Dunn, Federal Way, WA (US)

(73) Assignee: The Boeing Company, Chicago, IL (US)

( * ) Notice: Subject to any disclaimer, the term of this patent is extended or adjusted under 35 U.S.C. 154(b) by 261 days.

This patent is subject to a terminal disclaimer.

(21) Appl. No.: 12/627,917

(22) Filed: Nov. 30, 2009

Related U.S. Application Data

(63) Continuation-in-part of application No. 11/944,922, filed on Nov. 26, 2007, now Pat. No. 7,703,407.

(51) Int. Cl.
*B63B 35/44* (2006.01)

(52) U.S. Cl. ..... 114/258

(58) Field of Classification Search ..... 114/256, 114/257, 258, 261, 264, 266, 267, 312; 441/1, 441/21

See application file for complete search history.

(56) References Cited

U.S. PATENT DOCUMENTS

| | | | | | |
|---|---|---|---|---|---|
| 2,329,941 | A | * | 9/1943 | Posin | 114/261 |
| 3,273,526 | A | | 9/1966 | Glosten | |
| 3,327,668 | A | | 6/1967 | Von Schultz | |
| 3,339,511 | A | | 9/1967 | Daniell | |
| 3,413,946 | A | * | 12/1968 | Von Schultz | 114/264 |
| 3,575,005 | A | | 4/1971 | Sumner | |
| 3,778,854 | A | * | 12/1973 | Chow | 441/4 |
| 3,856,052 | A | | 12/1974 | Feucht | |
| 4,054,104 | A | | 10/1977 | Haselton | |
| 4,329,690 | A | | 5/1982 | Parker | |
| 4,556,341 | A | | 12/1985 | Ayers | |
| 4,557,390 | A | | 12/1985 | Mick | |
| 4,625,668 | A | * | 12/1986 | Fitch | 114/14 |
| 4,656,959 | A | | 4/1987 | Moisdon | |
| 4,665,857 | A | | 5/1987 | Akerman et al. | |
| 4,703,709 | A | | 11/1987 | Behar et al. | |
| 5,189,978 | A | | 3/1993 | McAllister | |
| 5,480,114 | A | | 1/1996 | Nakamura | |
| 6,263,824 | B1 | | 7/2001 | Balint et al. | |
| 6,341,573 | B1 | | 1/2002 | Buck | |
| 6,341,665 | B1 | | 1/2002 | Zhou et al. | |
| 7,040,247 | B2 | | 5/2006 | Chouery | |

OTHER PUBLICATIONS

BoatDesign.net forums, retrieved Sep. 18, 2007 at http://forums.boatdesign.net/showthread.php?t=815, Jelsoft Enterprises, Ltd., 8 pgs.

"Floating Instrument Platform—FLIP", retrieved on Feb. 24, 2009 at http://www.mpl.ucsd.edu/resources/flip.intro.html, MPL UCSD Resources, 2 pgs.

Wikipedia, "Brent Spar", retrieved on Feb. 24, 2009 at http://en.wikipedia.org/wiki/Brent_Spar_oil_rig, 8 pgs.

* cited by examiner

*Primary Examiner* — Daniel Venne
(74) *Attorney, Agent, or Firm* — Caven & Aghevli LLC

(57) ABSTRACT

Systems and methods for a stable maritime platform are disclosed. The platform is pivotally supported by a superstructure of a floating vessel, the platform to receive a downward force from an object. A platform trunnion is connected to the platform to convert the downward force on the platform into rotational movement. A counterweight axle is connected to the platform trunnion to transform the rotational movement into angular displacement that moves a counterweight away from the superstructure of the floating vessel. Thus, the downward force of the object may be counteracted to balance the floating vessel.

20 Claims, 9 Drawing Sheets

STABLE MARITIME VEHICLE PLATFORM

CROSS REFERENCE TO RELATED APPLICATION

This patent application is a continuation-in-part application of co-pending, commonly-owned U.S. patent application Ser. No. 11/944,922 entitled "Stable Maritime Platform", filed Nov. 26, 2007, which is incorporated herein by reference.

FIELD OF THE INVENTION

The field of the present disclosure relates to a convertible stable platform deployed as a spar buoy configuration, for vertical take-off and landing (VTOL) vehicles, such as helicopters.

BACKGROUND OF THE INVENTION

In deploying vertical take-off and landing (VTOL) vehicles, such as helicopters and tilt-rotor aircraft, near land masses, large aircraft carriers with stable landing platforms may be used. The use of an aircraft carrier can be expensive. Floating landing platforms (e.g., converted oil drilling platforms) may also be used; however, such floating landing platforms can expensive to build and slow to deploy. A temporary structure erected near a land mass can be expensive and time consuming.

The following scenario is described in the context of a military operation; however, similar scenarios are applicable in nonmilitary applications, where deployment of such VTOL aircraft may also be employed (e.g., oil exploration). In a military scenario, battle operations call for light, rapidly deployable, maneuver forces supported by remote munitions. Such maneuver forces rely on intermediate staging bases (i.e., landing and take off platforms) for VTOL vehicles, in or near the theater of operations to support troops, logistics, and combat fire support. A deployable sea base represents maneuverable capability to rapidly provide offensive and defensive power, as well as assembling, equipping, supporting and sustaining scalable forcible entry operations without the need for land bases in the joint area of operations. As discussed above, the use of large aircraft carriers, temporary platforms, and other solutions have proven to be costly and sometimes time consuming. Therefore, there is a need to provide a cost effective, highly deployable solution to providing staging areas (i.e., platforms) for VTOL vehicles.

Although desirable results have been achieved using prior art systems and methods, novel systems and methods that mitigate the above-noted undesirable characteristics would have utility.

SUMMARY

The convertible ship and platform in accordance with the teachings of the present disclosure may advantageously provide a stable highly deployable platform for VTOL vehicles, such as helicopters.

In one embodiment, a platform is pivotally supported by a superstructure of a floating vessel, the platform to receive a downward force from an object. A platform trunnion is connected to the platform to convert the downward force on the platform into rotational movement. A counterweight axle is connected to the platform trunnion to transform the rotational movement into angular displacement that moves a counterweight away from the superstructure of the floating vessel. Thus, the downward force of the object may be counteracted to balance the floating vessel.

In another embodiment, a floating vessel is balanced when the floating vessel receives a downward force from an object onto a platform that is pivotally supported by a superstructure of the floating vessel. The balancing includes converting the downward force to an angular displacement of one or more counterweights to oppose the downward force. The opposition of the downward force balances the floating vessel. During the balancing, the angular displacement of the one or more counterweights moves them away from the superstructure of the floating vessel.

In another embodiment, a floating vessel includes a superstructure that is disposed on a hull. The superstructure may pivotally support a platform that is to receive a downward force from landing of a vehicle. The floating vessel further includes a counterbalance mechanism to counterbalance the floating vessel against the landing of the vehicle on the platform. The counterbalance mechanism converts the downward force of the vehicle into to an angular displacement of one or more counterweights. The angular displacement opposes the downward force and balances the floating vessel against a weight of the vehicle.

The features, functions, and advantages that have been above or will be discussed below can be achieved independently in various embodiments, or may be combined in yet other embodiments, further details of which can be seen with reference to the following description and drawings.

BRIEF DESCRIPTION OF THE DRAWINGS

Embodiments of systems and methods in accordance with the teachings of the present disclosure are described in detail below with reference to the following drawings.

DETAILED DESCRIPTION

The present disclosure teaches systems and methods for a stable maritime platform. Many specific details of certain embodiments of the invention are set forth in the following description and in FIGS. 1-8 to provide a thorough understanding of such embodiments. One skilled in the art will understand that the invention may have additional embodiments, or that the invention may be practiced without several of the details described in the following description.

Described is a ship capable of converting into a spar buoy configuration and deploying a VTOL vehicle (e.g., helicopter) landing and takeoff platform positioned significantly above the wave heights of heavy seas. The platform is stable in mild to severe sea states, and can be deployed in mid mid-ocean or littoral waters.

The ship includes a buoyancy mode, which is selectable between a conventional ship and spar buoy. The ship further includes the VTOL landing and takeoff platform. The ship has advantages over prior ships employing platforms providing similar features. An advantage is reduction in vessel displacement for a given platform area, resulting in the ability to convert the ship between different configurations. A primary benefit of a reduced displacement of this vessel concept is reduced construction, procurement, and operations cost. In particular, the ship may be converted to a conventional sea going ship for transport to theater of operations, and then be converted as a spar buoy for on-station duty. Rather than rely on large-displacement hulls for platform stability, the ship employs stable dynamics of a spar buoy. As a side benefit, since the ship is smaller than other ships serving similar purposes (e.g., aircraft carriers), a far smaller crew may be employed.

Figure 1:
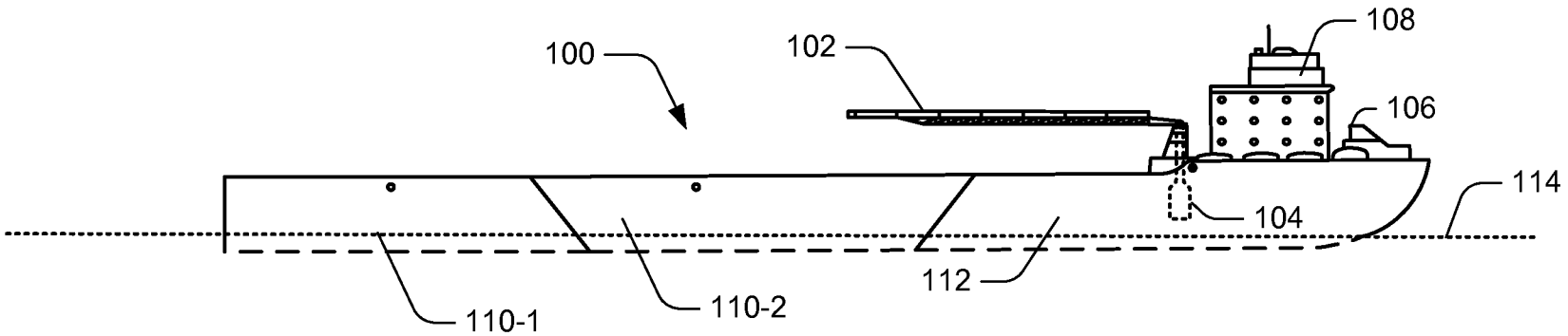
FIG. 1 is a side isometric view of a ship that implements a stable convertible platform for VTOL vehicles, in accordance with various embodiments.

FIG. 1 illustrates a ship 100 that employs a stable VTOL landing and takeoff platform 102. The ship 100 in is in conventional sea going mode. In at least one embodiment, the ship 100 may include a single hull 112 that contacts a waterline 114. However, the ship 100 may include multiple hulls that contact the water line 114 in other embodiments. The platform 102 is erected or deployed with an associated actuation and balance system 104. The ship includes a control and command section 106, and crews' quarters 108 for support personnel. It is contemplated that control and control section 106 and crews' quarter can include communication, and navigation facilities, crew berthing, and medical facilities.

The ship 100 may further include power and propulsion equipment; ballast tanks; fuel tanks; buoyancy management and fueling systems, aspects of which are designed for normal operation in either a horizontal (sea going) or vertical orientation (spar buoy).

In this example, the ship 100 includes one or more ballast tanks 110-1 and 110-2 (although, two are shown as an example, it is contemplated that additional ballast tanks may be employed). The ballast tanks 110 are empty when the ship 100 is in a sea going configuration. In some embodiments, when the ship is deployed as a spar buoy, the ballast tanks 110-1 and 110-2 may be filled with water. As the ballast tanks 110-1 and 110-2 fill with water, the ship becomes vertically oriented and the platform may be deployed. However, in other embodiments, when the ship is deployed as a spar buoy, the ballast tank 110-1 may be filled with seawater, while the ballast tank 110-2 may be filled with sufficient water trim the height of ship above the water line 114. In this "flipping" operation, the ballast tanks 100 can be flooded by venting air. A "hard" tank can be implemented that could withstand full hydrostatic differential pressure during the flipping operation, in order to prevent "plunging" that would otherwise occur if the tanks were allowed to flood freely. Tank partitioning (e.g., multiple tanks) and the addition of ballast in the horizontal keel may also be employed to allow for safe flipping operation.

The exemplary implementation describes the use of ballast tanks to transition the ship 100 to the vertical orientation; however, it is contemplated that other techniques or "flipping" mechanism may be employed. For example, the use of shifting weights and balances may be employed.

As discussed below, an exemplary dimension for the platform 102 may be 100 feet in diameter. This may translate into a particular ship structure weight (size), where the ship structure weight scales as the area of the hull, decks, and bulkheads. In consideration of the weights of the platform 102, actuation and balance system 104, control and command section 106, crews' quarters 108, propulsion equipment, fueling equipment, communication equipment, etc., an estimated total weight (displacement) for the ship 100 would be 3,000 tons.

Figure 2:
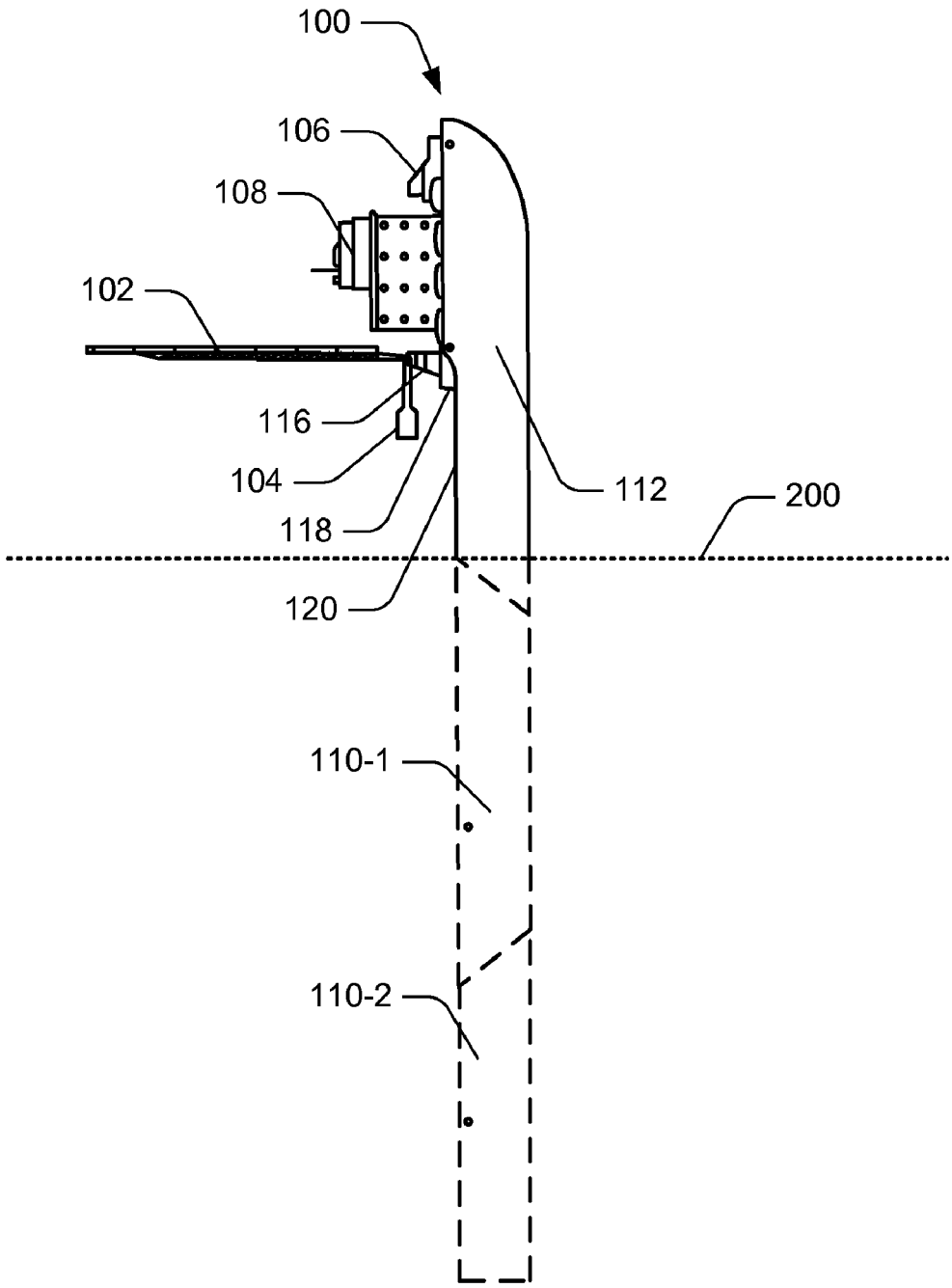
FIG. 2 is a side isometric view of a ship implementing a stable convertible platform in a spar buoy configuration, in accordance with various embodiments.

FIG. 2 illustrates the deployment of the ship 100 in vertical orientation, or as a spar buoy. The ship 100 is deployed as a spar buoy, and the platform 102 is particularly configured to support takeoff and landing of VTOL vehicles. A flipping mechanism may be employed, and in this example ballast tanks 110 are filled with sea water, causing the ship 100 to "flip" into the vertical orientation.

The platform 102 may be erectable over a rotation angle of 90 degrees. The platform may be supported by a cantilever structure 116 that is disposed on the superstructure 118, and rotated into operational position as the hull of ship 100 progressively transitions from horizontal to vertical orientation. In at least one embodiment, the platform may 102 may be rotated from a position that is parallel or substantially parallel to a deck 120 of the ship 100 as the ship 110 is operating in the horizontal or sea going orientation, to an operational position that is perpendicular or substantially perpendicular to the deck 120 as the ship 110 transits to a vertical spar buoy orientation. Thus, the rotation of the platform 102 may ensure that the platform 102 may be deployed parallel or substantially parallel to a waterline 200 regardless of whether the ship 100 is operating as a seagoing vessel or a spar buoy.

The transition of the platform 102 may be particularly supported by the actuation and balance system 104. A fully loaded helicopter (VTOL vehicle) may gross as much as 25 tons. If such a heavily-loaded air vehicle were to settle on the platform 102, the ship 102 may be caused to tilt away from vertical reference. One way to counter this effect is to implement counterweights that engage at a support axle or trunnion of the platform 102. Therefore as a helicopter or other air vehicle touches down on the platform 102, the imposition of weight on the platform 102 would react through a geared lever to move a counterweight on the other side of the vessel. The implementation of the counterweights for the platform 102 to compensate for the downward force associated with aircraft landing is illustrated in FIGS. 3*a* and 3*b*.

Figure 3A:
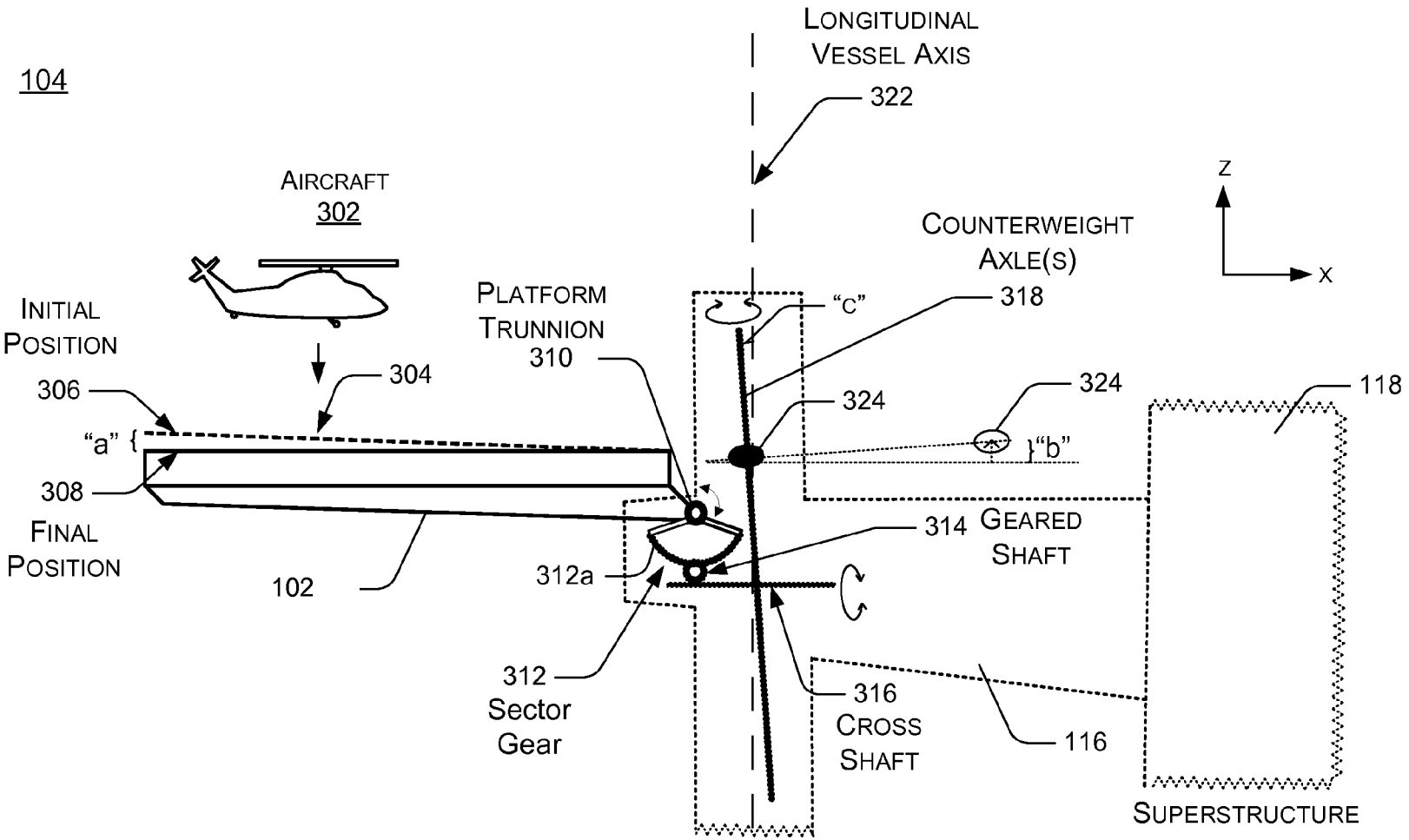
FIG. 3*a* is an elevation view of a stable convertible platform of a ship that is counterbalanced via an actuation and balance system upon the landing of an aircraft, in accordance with various embodiments.
Figure 3B:
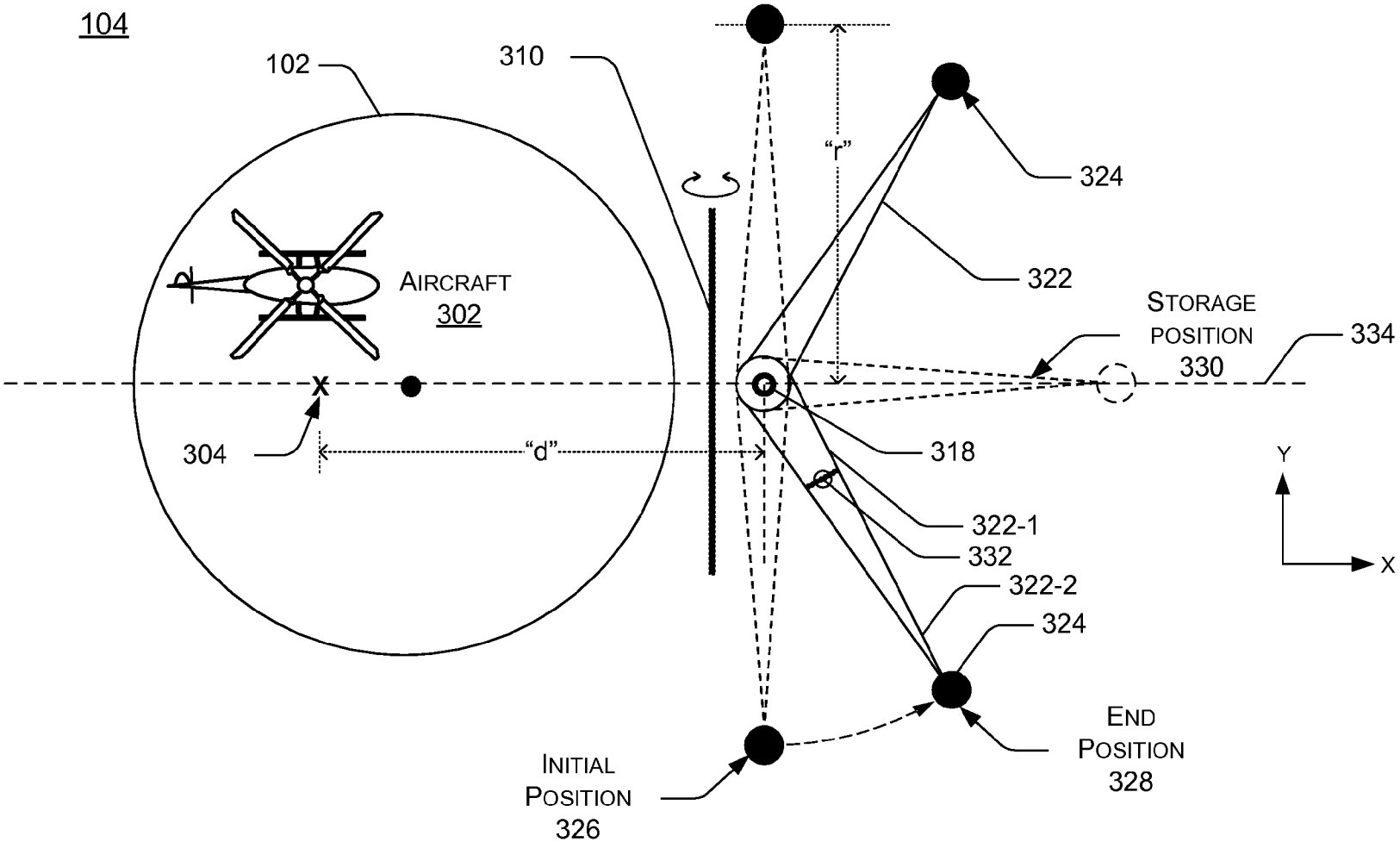
FIG. 3*b* is a plan view of a stable convertible platform of a ship that is counterbalanced via an actuation and balance system upon the landing of an aircraft, in accordance with various embodiments.

FIG. 3*a* is an elevation view of a stable convertible platform of a ship that is counterbalanced via an actuation and balance system 104 upon the landing of an aircraft. As shown in FIG. 3*a*, the system 104 may include the platform 102. The platform 102 may be pivotally supported by the cantilever structure 116 that is disposed on the superstructure 118 of the ship 100. An aircraft 302 may touch down on the platform 102 at a location 304. In various instances, the location 304 may be at the center of the platform 102 or off-center of the platform 102.

The landing of the aircraft 302 may cause the platform 102 to settle a distance "a" from a starting position 306 to a final position 308. The settling of the platform 102 for the distance "a" may cause rotation of a platform trunnion 310. For example, a 2 feet settling of the platform 102 may result in a 2.5 degrees rotation of the platform trunnion 310. The platform trunnion 310 may drive a sector gear 312 that is integrally affixed to the platform trunnion 310. Thus, a rotation of the platform trunnion 310 may rotate the sector gear 312 to the same degree. In turn, the sector gear 312 may mesh with a geared shaft 314. In at least one embodiment, the geared shaft 314 may be positioned parallel or substantially parallel to the platform trunnion 310.

In various embodiments, the perimeters of the sector gear 312 and geared shaft 314 of the system 104 may be arranged to amplify the rotation of the platform 102 around the platform trunnion 310. For example, but not as a limitation, the sector gear 312 may include an enlarged perimeter gear portion 312*a*. In at least one embodiment, the arrangement of the enlarged perimeter gear portion 312*a* and the geared shaft 314 may generate a rotation multiplier of approximately 12.5. Thus, in such an example, an initial 2.5 degrees rotation of the platform 102 may generate a final rotation of approximately 31.4 degrees of the geared shaft 314.

The geared shaft 314 may mesh with a cross shaft 316 of the system 104 at a right angle or a substantially right angle. The geared shaft 314 may transmit rotational movement perpendicularly to the cross shaft 316. In some embodiments, the geared shaft 314 may transmit the perpendicular rotational movement via crossed helical gears that are present on both the geared shaft 314 and the cross shaft 316. In other embodiments, the geared shaft 314 may transmit the perpendicular rotational movement via one or more other types of gears on the geared shaft 314 and the cross shaft 316, such as beveled gears, worm gears, and/or the like. However, it will be appreciated that in further embodiments, additional mechanical force transfer components may also be implemented with the gears to transmit the rotational movement (e.g., universal joints, chains, belts, and/or the like).

In some embodiments, the cross shaft 316 may further mesh with one or more counterweight axles at right angles substantially right angles, i.e. perpendicular. The cross shaft 316 may transmit rotational movement perpendicularly to the each counterweight axles 318. The cross shaft 316 may transmit the perpendicular rotational movement via various types of gears (e.g., crossed helical gear, beveled gears, worm gears, and/or the like) that are present on the cross shaft 316 and each counterweight axles 318. In other embodiments, other mechanical force transfer components may also be implemented with the gears to transmit the rotational movement (e.g., universal joints, chains, belts, and/or the like).

Each of the one or more counterweight axles 318 may intersect a longitudinal vessel axis 320. The longitudinal vessel axis 320 may bisect the center of mass of the ship 100 that is deployed as a spar buoy. In at least some embodiments, the longitudinal vessel axis 320 may also be perpendicular or substantially perpendicular to a water line 200 (FIG. 2). Further details regarding the implementation of the counterweights that engage at a support axle or trunnion is illustrated in FIG. 3*b*.

FIG. 3*b* is a plan view of a stable convertible platform of a ship that is counterbalanced via the actuation and balance system 104 upon the landing of an aircraft. As shown in FIG. 3*b*, a cantilever arm 322 may be attached to each of the counterweight axles 318. Further, the distal end of each cantilever arm 322 may be attached to a counterweight, such as one of the counterweights 324. Thus, as shown in FIG. 3*b*, a rotational force exerted on the cross shaft 316 may be transmitted to each counterweight axle 318 to pivot a corresponding counterweight about each axle 318, and away from the center of mass of the spar buoy. Thus, the resultant angular displacement of the one or more counterweights 324 away from the longitudinal vessel axis 320 may sufficiently balance the downward moment imposed by the landing of the aircraft 302.

The angular displacement of the one or more counterweights 324 to balance the downward movement may pivot at least one counterweight 324 from an initial position to an end position. For example, one of the counterweights 324 shown in FIG. 3*b* may pivoted from a position 326 to an end position 328. In embodiments where a pair of counterweights 324 is deployed at the end of corresponding cantilever arms 322, the various components of the balance and actuation systems 104 may be configured so that each counterweight 324 may be symmetrically pivoted by the same amount of angular displacement.

In a non-limiting example, the aircraft 302 may be a 25-ton aircraft. The 25-ton aircraft may land on platform 102 at a distance "d" of 50 feet from the center of the two counterweights axles 318. Accordingly, the resultant displacement moment may be expressed as "25 ton×50 ft=1250 ton-ft." Thus, in order to balance this displacement, two counterweights 324 that weigh 30 tons each may be placed a corresponding cantilever arm 322. Each of the cantilever arms may have a length "r" of 40 ft. Further, the various shafts and gears may be configured to angularly displace each of two counterweights in a 31.4 degrees arc, or a total distance of 20.8 feet. Accordingly, the resultant symmetrical displacement moment of the two counterweights 324 may be expressed as "2×30 tons×20.8 feet=1250 ton-ft". As may be observed from this example implementation, the spar buoy may remain in equilibrium during and after the landing the aircraft 302, as the total displacement moment of the aircraft 302 is equivalent to the displacement moment of the two counterweights 324.

In other embodiments shown in FIG. 3*a*, the one or more counterweight axles 318 may be further inclined at a predetermined angle "c" with respect to the longitudinal axis 320. Accordingly, the angular displacement of each counterweight 324 may be accompanied by its elevation by a distance of "b". In various embodiments, the predetermine angle of inclination "c" may be configured so that the angular movement of the counterweights may be proportionate to the weight of the landing aircraft 302, which may facilitate proportionality of the moment balance.

However, in additional embodiments, the downward moment imposed by the landing of the aircraft 302 may be balanced by the angular displacement of the one or more counterweights 324 even when the one or more counterweight axles 318 are parallel to the longitudinal vessel axis 320. In other words, moment balance may be achieved with the angular movement the one or more counterweights 324 without the accompanying elevation. Thus, with the implementation of the balance and actuation system 104 shown in FIGS. 3*a* and 3*b*, the desired balance of the spar buoy's equilibrium during the landing of aircraft 302 on the platform 102 may be achieved.

In further embodiments, each cantilever arm 322 that supports its corresponding counterweight 324 may be provided with a mechanism that folds that arm alongside the hull of the ship 100 while it is in a sea going or horizontal orientation.

Each of the one or more cantilever arms 322 may be further deployed to a corresponding initial balanced position (e.g., initial position 326) when the ship 110 is deployed as a spar buoy. For example, the one or more cantilever arms 322 may be simultaneously deployed with the deployment of the platform 102.

In some of these embodiments, each cantilever arm 322 may be equipped with a rotating lock mechanism that locks the arm in both a storage position 330 and an initial position (e.g., initial position 326) with respect to its counterweight axle 318. In other of these embodiments, each cantilever arm 322 may be provided with a lockable joint mechanism (e.g., swivel joint, hinge joint, and/or the like) that enables compact storage. For example, as shown in FIG. 3*b*, one of the cantilever arms 322 may include a portion 322-1 that rotate with respect to a portion 322-2 via a lockable joint mechanism 332. The lockable joint mechanism 332 may enable the cantilever arm portion 322-2 to rotate towards a center line 334 during storage, as well as away from the center line 334 to the initial position 326 during deployment. In embodiments where a pair of counterweights 324 is deployed at the end of a pair of cantilever arms 322, at least a portion of each cantilever arm 322 may be symmetrically moved for storage and deployment.

It will be appreciated that in alternative embodiments, the geared shaft 314 may be arranged to interface directly with the one or more counterweight axles 318. In such embodiments, the geared shaft 314 may transmit its rotation movement perpendicularly to each of the counterweight axles 318 via helical gears, beveled gears, worm gears, and/or the like. Thus, the balance and actuation system 104 may be simplified to transmit the downward moment imposed by the landing of the aircraft 302 to the one or more counterweights 312 without the implementation of the cross shaft 316.

Returning to FIG. 2, the waterline 200 indicates position of the ship in relation to the ocean or sea. In this vertical position, the platform 102 is less susceptible to effects from waves and sea movement. In one instance, the platform 102 may experience less than 1 meter vertical motion in the presence of waves that are 10 meters high.

The platform 102 may be sized to support particular VTOL vehicles. For example, 55-foot-diameter platform 102 has an area of 2,376 square feet. This would be marginally sufficient to support an AH-64D Apache Longbow helicopter having a rotor diameter of 48 feet and fuselage length of 58 feet. For larger vehicles, such as a CH-47F Chinook helicopter having a rotor diameter of 60 ft. and a shaft separation distance of 39 feet) or a V-22 Osprey helicopter with a rotor diameter of 38 feet and approximate wingspan of 47 feet, the diameter of platform 102 should be increased to approximately 100 feet, for an area of 7,854 square feet.

In sea going configuration or horizontal orientation, a large 100 foot diameter platform may not travel well. For example, ocean swells may roll up into the broadside overhang of the platform 102. Therefore, it may desirable for the platform 102 to collapse into a smaller beam dimension when the ship is in sea going configuration. This can be accomplished by segmenting the platform 102 onto separate elements, such that when erected, they are juxtaposed and structurally locked together.

Figure 4A:
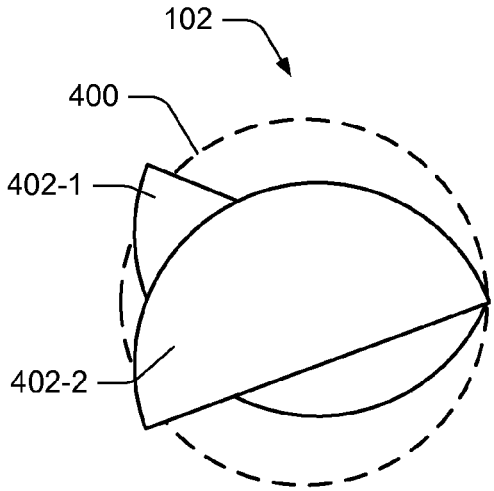
FIG. 4*a* is a top isometric view of a stable convertible platform in a semi-circle configuration, in accordance with various embodiments.

FIG. 4*a* illustrates one example of a segmented platform 102. The fully deployed platform 102 is in a circular shape 400. Circular shape is segmented into semi-circle shapes 402-1 and 402-2. When the ship 100 is in sea going or horizontal orientation, the platform 102 is broken up into semi-circle shapes 402.

Figure 4B:
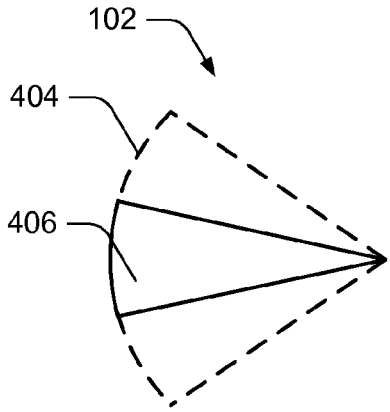
FIG. 4*b* is a top isometric view of a stable convertible platform in a pie shape configuration, in accordance with various embodiments.

FIG. 4*b* illustrates an alternate shape to break up segmented platform 102. In this example platform 102 is broken up into fan shape 404 that may be segmented into smaller pie shapes 406. It is contemplated that the number and type of segments (shapes) constitute a design optimization exercise. And it is contemplated that the outline of platform 102 can be circular, fan-shaped, polygonal, or any other profile that is suitable for the purpose.

Figure 5:
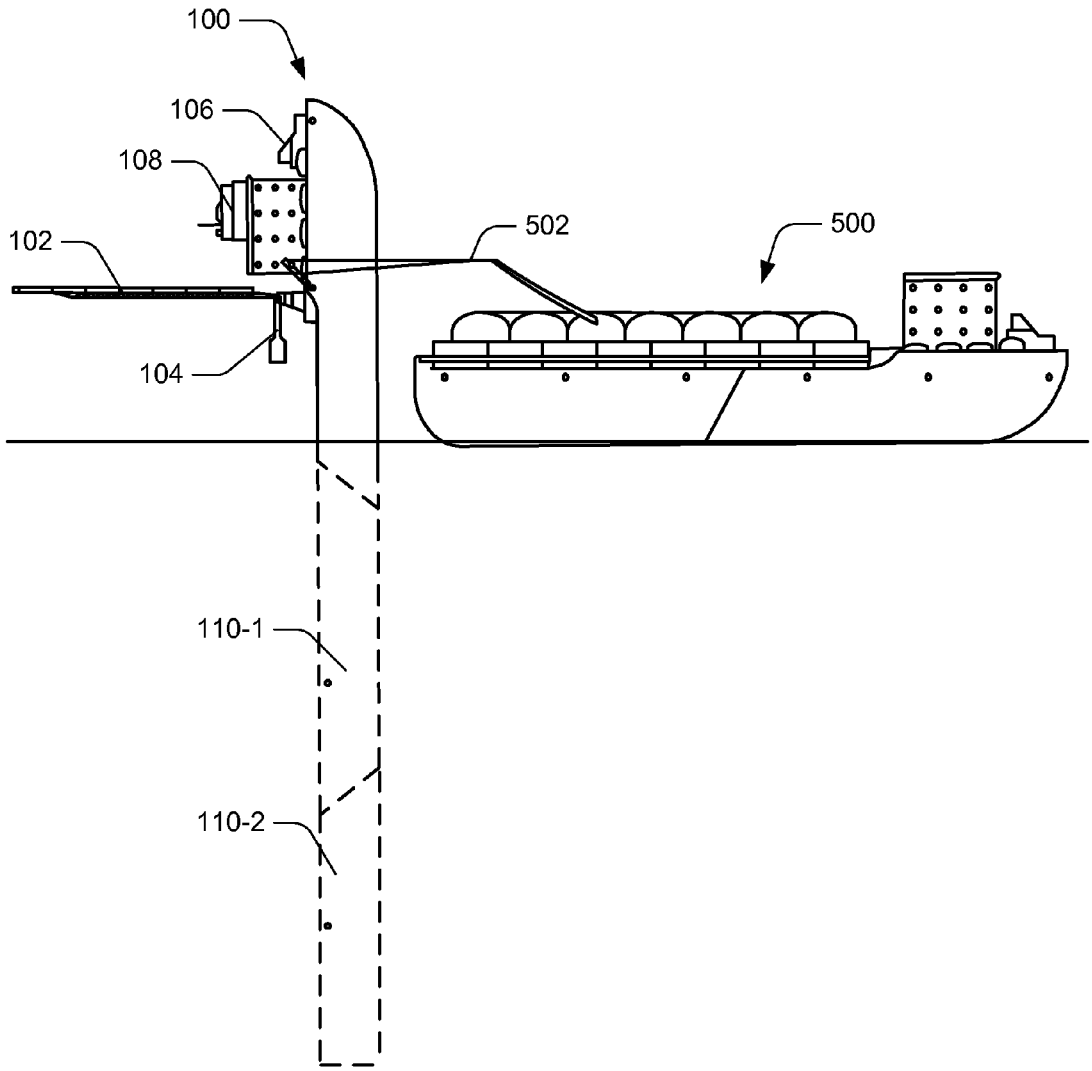
FIG. 5 is a side isometric view of a ship implementing a stable convertible platform in a refueling configuration, in accordance with various embodiments.

FIG. 5 illustrates refueling configuration. For prolonged deployments (i.e., missions), food and other provisions may be provided to the ship 100 and crew. Certain supplies, such as food and other provisions may be provided through vertical airlift. Water can be generated from on-board desalinization equipment. For utilities of the ship, such as those related to motive (i.e., propulsion and movement, and electrical power), petroleum based fuels may be needed. In addition, such fuels may be needed to support aviation assets (i.e., VTOL aircraft). Such fuel may also need to be transferred at sea on a continual basis.

Therefore, the ship 100 should be provided with the capability for at sea refueling. Fuel may be received by ship 100 from oilers and similar replenishment vessels, as represented by vessel 500, and provided to the ship 100 through line carrying booms 502, which can be rotated or extended into position.

Figure 6:
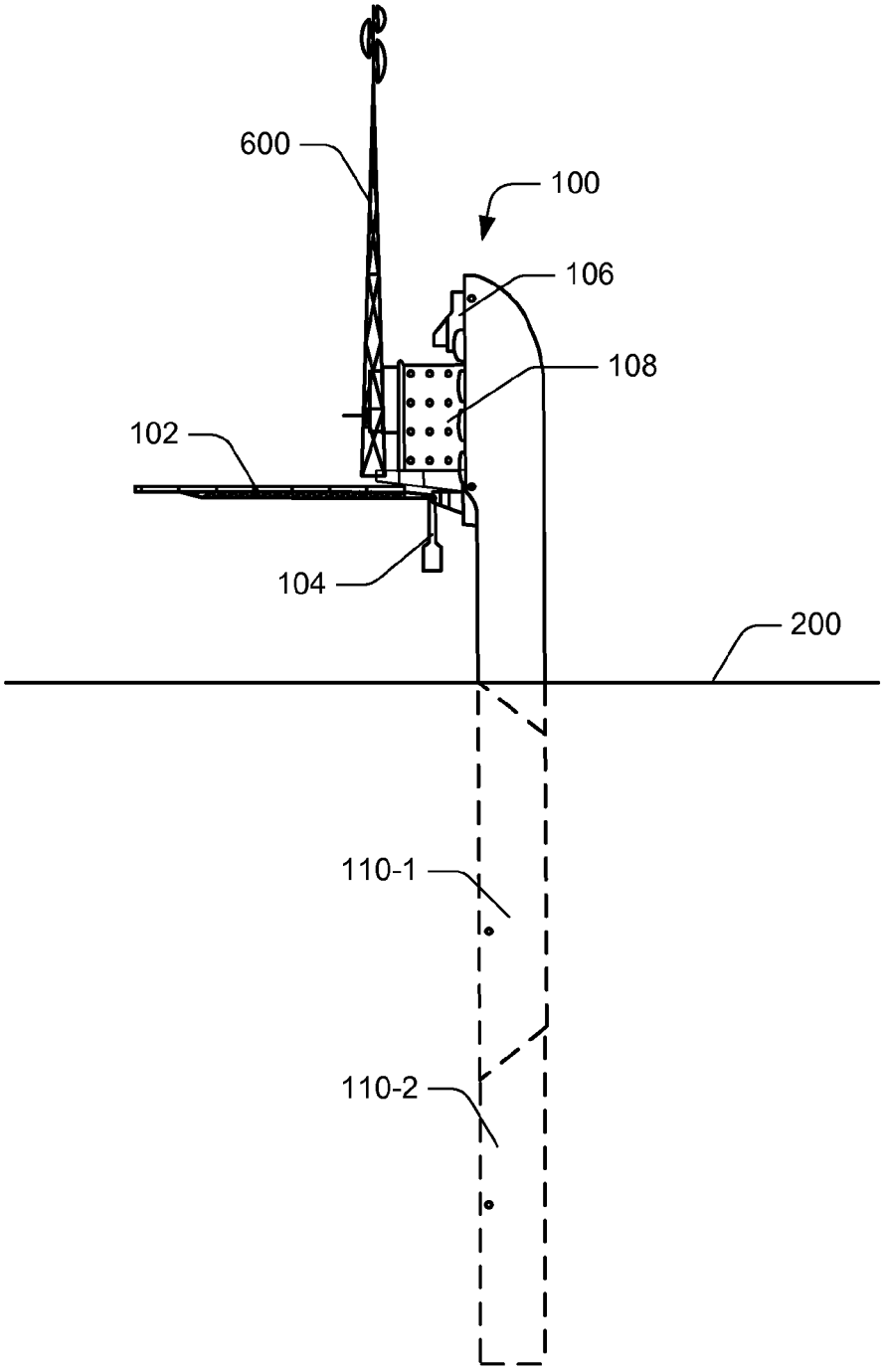
FIG. 6 is a side isometric view of a ship implementing a stable convertible platform with antennae, in accordance with various embodiments.

FIG. 6 illustrates a configuration with deployable communication systems and antennas 600. In support of VTOL aircraft, and operations or deployment in a littoral environment, there may be a need for intensive communication networking for deployed forces using ship 100. Therefore, deployable communication systems and antennas 600 may be included in ship 100 for such communication networking. A possible scenario is main ships in a deployed formation (aircraft carriers, assault carriers, etc.) may find their available communication channels overloaded. If such a circumstance arises, it may be beneficial for the main command-and-control vessels to "pipe" bundles of high-data-load communication over communication networks, such as Ku- and Ka-band microwave beams to nearby deployable ships such as ship 100 through communication systems and antennas 600. High-data-load communication bundles can be unbundled and retransmitted, for example, over additional X-band or C-band radio links provided by communication systems and antennas 600. Communication systems and antennas 600 can include an extensible radio antenna mast and suitable communications equipment.

Exemplary Methods

Figure 7:
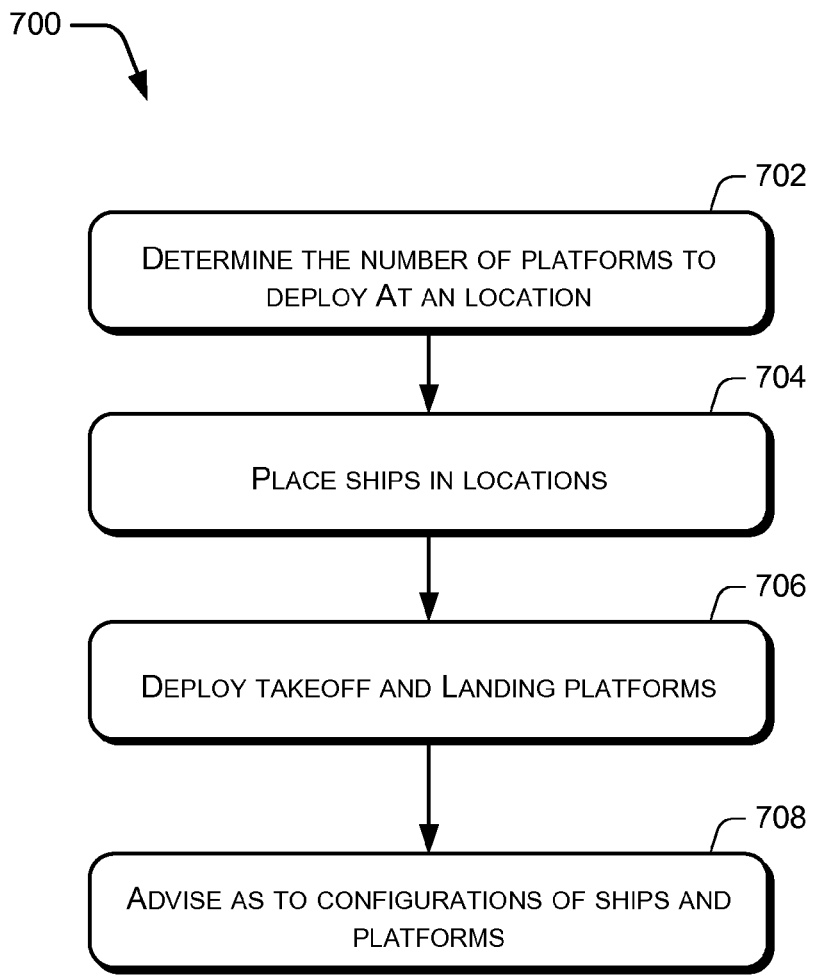
FIG. 7 is a flowchart illustrating implementation of multiple stable convertible platforms implemented as spar buoys, in accordance with various embodiments.

Exemplary scenarios for deploying convertible stable platform deployed as a spar buoy configuration, for vertical takeoff and landing (VTOL) vehicles, are described with reference to FIGS. 1-6. FIG. 7 illustrates an exemplary method 700 for deployment of ships, such as ship 100. The order in which the method is described is not intended to be construed as a limitation, and any number of the described method blocks can be combined in any order to implement the method.

At block 702, a determination is performed as to the number of takeoff and landing platforms to support VTOL vehicles. In certain implementations, the platforms may be used for transoceanic fueling stops for overseas deployment of VTOL vehicles. The platforms are particularly deployable platforms on ships, such as ship 100. The determination includes locations of the platforms in a specific theatre of operation. Factors can include the type of operations such as military, search and rescue, observation, and research. The determination can also include the capabilities needed from the ships, including communications and refueling.

At block 704, a placement of the ships is performed. In particular, ships such as ship 100 are deployed. The ships are sent to their respective locations in a sea going or horizontal position. While in transit, the platforms of the ships may be collapsed into a more suitable size for sea going travel. In particular, the platforms may be collapsed into one of various compacted shapes as described above in reference to FIG. 4.

At block 706, a deployment is performed for the respective platforms. Deployment is performed after the ships have been placed in their respective locations. The deployment can include reconstructing a compacted platform. In other words, if the platform has been compacted, the platform may be reassembled into a circular shape once the ship is in place. Deployment can include transitioning of the ship(s) from conventional sea going or horizontal orientation to a spar buoy or vertical orientation. The transitioning may be implemented using a flipping mechanism, such as the use of ballast tanks 110 described above. Reassembling the platform can take place before or after transitioning orientation of the ship. Part of the deployment includes rotating the platform into operational position as described above. This may be performed using the actuation and balance system 104 described above.

At block 708, an advisement is provided as to configuration and resources available at the ships and platforms. The advisement may be provided to various locations, including base operations and individual VTOL vehicles. Resources can include, among various resources, the size of a platform at a ship that can support particular VTOL vehicles. Other resources can include refueling ability of the ship (i.e., can VTOL vehicles be fueled at the particular ship). Communications resources of the ship may also be provided. In particular, specific communications ability of the ship may be provided. Other example resources include size of crew or crew's quarters to accommodate a maximum number of crew.

Figure 8:
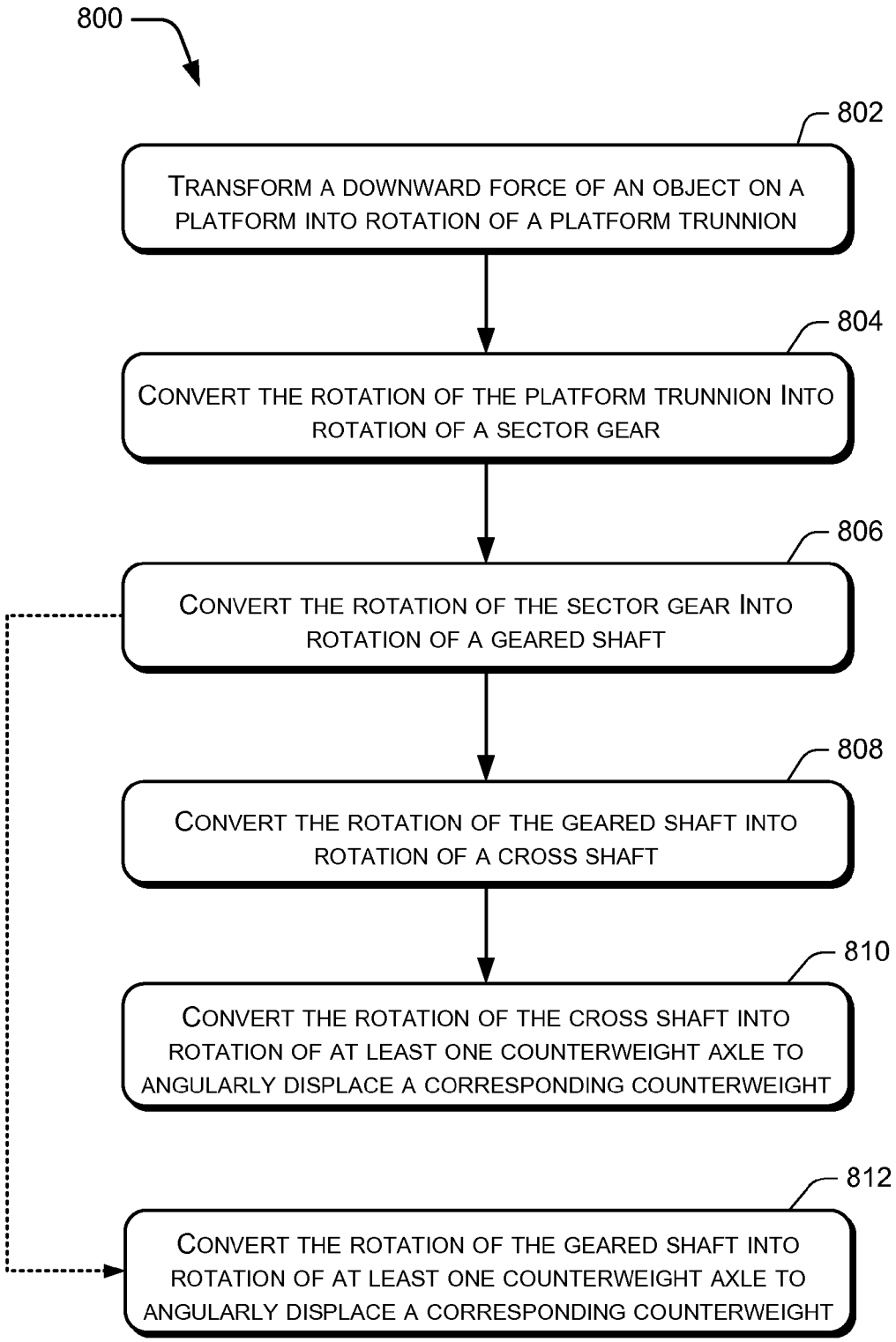
FIG. 8 is a flowchart illustrating the counterbalance of a stable convertible platform of a ship upon the landing of an aircraft, in accordance with various embodiments.

FIG. 8 illustrates an exemplary method 800 for counterbalance a stable convertible platform of a ship upon the landing of an aircraft. At block 802, a downward force of an object landing on a platform may be transformed into rotation of a platform trunnion that is coupled to the platform. In various embodiments, the platform may be pivotally attached to a superstructure 118 of a ship 100 that is deployed as a spar buoy. The object may be a VTOL vehicle, such as a helicopter.

At block 804, the rotation of the platform trunnion 310 may be converted into rotation of a sector gear that is coupled to the platform trunnion 310. In various embodiments, the sector gear 312 may include an enlarged gear portion 312 that amplifies the rotation of the platform trunnion.

At block 806, the rotation of the sector gear 312 may be converted into rotation of a geared shaft 314 that is coupled to the sector gear 312. In various embodiments, the geared shaft may 314 be positioned parallel or substantially parallel to the platform trunnion 310.

At block 808, the rotation of the geared shaft 314 may be converted into rotation of a cross shaft 316 that is coupled to the geared shaft 314. In various embodiments, the cross shaft 316 may be positioned perpendicular or substantially perpendicular to the geared shaft 314.

At block 810, the rotation of the cross shaft 316 may be converted into rotation of at least one counterweight axle 318 that is coupled to the cross shaft 316. The rotation of the at least counterweight axle 318 may angularly displace a corresponding counterweight 324 oppose the downward force of the object and restore the equilibrium of the ship. In some embodiments, the at least one counterweight axle 318 may be positioned perpendicular or substantially perpendicular to the cross shaft 316. In other embodiments, the at least one counterweight axle 318 may be positioned at a predetermined degree of incline from perpendicularity to the cross shaft 316. In such embodiments, the angular displacement of the corresponding counterweight 324 may also be accompanied by elevation of the corresponding counterweight. The elevation of the corresponding counterweight 324 may enable the angular displacement of the corresponding counterweight to be proportional to a weight of the object.

However, in alternative embodiments, the geared shaft 314 may be arranged to interface directly with the one or more counterweight axles 318 to displace the corresponding counterweights 324. Thus, in such embodiments, the block 806 of the process 800 may proceed to block 812 rather than to block 808. At block 812, the rotation of the geared shaft 316 may be converted into rotation of at least one counterweight axle 318 that is coupled to the geared shaft 316. The rotation of the at least counterweight axle may angularly displace a corresponding counterweight to oppose the downward force of the object and restore the equilibrium of the ship, as previously described with respect to block 810.

CONCLUSION

While specific embodiments of the invention have been illustrated and described herein, as noted above, many changes can be made without departing from the spirit and scope of the invention. Accordingly, the scope of the invention should not be limited by the disclosure of the specific embodiments set forth above. Instead, the invention should be determined entirely by reference to the claims that follow.

What is claimed is:

1. A method to balance a floating vessel, comprising:

receiving a downward force on a platform that is pivotally supported by a superstructure disposed on the floating vessel; and converting the downward force to an angular displacement of at least one counterweight to oppose the downward force and balance the floating vessel, wherein the angular displacement moves the at least one counterweight away from the superstructure of the floating vessel.

2. The method of claim 1, wherein the at least one counterweight is attached to a corresponding cantilever arm, further comprising moving the cantilever arm from a storage position to a deployed position, the deployed position to enable the at least one counterweight to be angularly displaced from the superstructure of the floating vessel.

3. The method of claim 1, wherein the floating vessel is a spar buoy and the downward force is generated by a vertical take-off and landing (VTOL) vehicle.

4. The method of claim 1, further comprising converting the downward force to an elevation of the one or more counterweights that corresponds with the angular displacement, the elevation enabling the angular displacement of the at least one counterweight to be proportional to a weight of the object.

5. The method of claim 1, wherein the angular displacement moves the one or more counterweights in a substantially lateral direction away from the superstructure.

6. The method of claim 1, wherein the converting includes:

transforming the downward force to rotation of a platform trunnion;

converting the rotation of the platform trunnion into rotation of a sector gear that amplifies the rotation of the platform trunnion;

converting the rotation of the sector gear into rotation of a geared shaft;

converting the rotation of the geared shaft into rotation of a cross shaft that is perpendicular or substantially perpendicular to the geared shaft; and converting the rotation of the cross shaft into rotation of at least one counterweight axle that is perpendicular or substantially perpendicular to the cross shaft, wherein the at least one counterweight axle is to angularly displace the at least one counterweight.

7. The method of claim 1, wherein the converting includes converting the downward force into rotation of at least one counterweight axle that is inclined at an angle with respect to a longitudinal vessel axis that intersects a center of mass of the floating vessel, the at least one counterweight axle to angularly displace the at least one counterweight.

8. The method of claim 1, wherein the converting includes:

transforming the downward force to rotation of a platform trunnion;

converting the rotation of the platform trunnion into rotation of a sector gear that amplifies the rotation of the platform trunnion; and converting the rotation of the sector gear into rotation of at least one counterweight axle, wherein the at least one counterweight axle is to angularly displace the at least one counterweight.

9. A system to balance a floating vessel, comprising:

a platform that is pivotally supported by a superstructure of the floating vessel, the platform to receive a downward force;

a platform trunnion to convert the downward force on the platform into rotational movement of a sector gear that is coupled to the platform trunnion; and a counterweight axle to transform the rotational movement of the sector gear into angular displacement of a cross shaft coupled to the sector gear by a gear shaft, and that moves a counterweight away from the superstructure of the floating vessel to counteract the downward force.

10. The system of claim 9, further comprising a sector gear to amplify the rotational movement of the platform trunnion.

11. The system of claim 9, wherein the counterweight axle is perpendicular or substantially perpendicular to a cross shaft, further comprising:

a sector gear to amplify the rotational movement of the platform trunnion;

a geared shaft to transfer the rotational movement from the sector gear to the cross shaft that is perpendicular or substantially perpendicular to the geared shaft; and wherein the cross shaft is to transform the amplified rotational movement into rotational movement of the counterweight axle.

12. The system of claim 9, wherein the counterweight is attached to the counterweight axle via a cantilever arm, the cantilever arm including a locking mechanism that deploys the cantilever arm from a storage position to a deployed position, deployed position to enable the counterweight to be angularly displaced from the superstructure of the floating vessel.

13. The system of claim 9, wherein the floating vessel is a spar buoy and the object is a vertical take-off and landing (VTOL) vehicle.

14. The system of claim 9, wherein the counterweight axle is inclined at an angle with respect to a longitudinal vessel axis that intersects a center of mass of the floating vessel, the inclined counterweight axle to further use the rotational movement to simultaneously elevate the counterweight to enable the angular displacement of the counterweight to be proportional to the downward force of the object.

15. A floating vessel, comprising:

a superstructure that is disposed on a hull;

a platform that is pivotally supported by the superstructure, the platform to receive a downward force from landing of a vertical take-off and landing (VTOL) vehicle;

a counterbalance assembly to counterbalance the floating vessel against the landing of the VTOL vehicle on the platform by converting the downward force of the VTOL vehicle into to an angular displacement of at least one counterweight, the angular displacement to oppose the downward force and balance the floating vessel.

16. The floating vessel of claim 15, wherein the counterbalance assembly includes:

a platform trunnion to convert the downward force on the platform into rotational movement; and a counterweight axle to transform the rotational movement into angular displacement that moves a counterweight away from the superstructure of the floating vessel to counteract the downward force of the object.

17. The floating vessel of claim 15, wherein the counterweight axle is inclined at an angle with respect to a longitudinal vessel axis that intersects a center of mass of the floating vessel, the inclined counterweight axle to further use the rotational movement to elevate the counterweight to enable the angular displacement of the counterweight to be proportional to the downward force of the object.

18. The floating vessel of claim 15, wherein the platform is segmented and collapsed into a more compact arrangement.

19. The floating vessel of claim 15, wherein the platform is segmented into a semi-circle shape or a pie shape.

20. The floating vessel of claim 15, wherein the hull is convertible from a ship to a spar buoy, and the platform is deployed from a storage position as the hull is progressively converted from the ship to the spar buoy.

* * * * *